US007628122B2

(12) United States Patent
Min

(10) Patent No.: US 7,628,122 B2
(45) Date of Patent: Dec. 8, 2009

(54) METHOD FOR MAXIMUM EFFICIENCY OF NON-CONDENSING BOILER

(75) Inventor: Tae-Sik Min, Dongjak-gu (KR)

(73) Assignee: Kyungdong Network Co., Ltd., Seoul (KR)

( * ) Notice: Subject to any disclaimer, the term of this patent is extended or adjusted under 35 U.S.C. 154(b) by 292 days.

(21) Appl. No.: 11/795,910

(22) PCT Filed: Jan. 27, 2006

(86) PCT No.: PCT/KR2006/000304

§ 371 (c)(1),
(2), (4) Date: Jul. 24, 2007

(87) PCT Pub. No.: WO2006/080811

PCT Pub. Date: Aug. 3, 2006

(65) Prior Publication Data

US 2009/0120382 A1 May 14, 2009

(30) Foreign Application Priority Data

Jan. 28, 2005 (KR) ..... 10-2005-0008247

(51) Int. Cl.
*F24H 9/20* (2006.01)

(52) U.S. Cl. ..... 122/448.1; 122/14.22; 700/19

(58) Field of Classification Search ..... 122/20 B, 122/31.1, 33, 448.14; 236/14; 60/39.182, 60/775; 392/451; 700/274, 275, 276
See application file for complete search history.

(56) References Cited

U.S. PATENT DOCUMENTS 3,814,321 A * 6/1974 Mulholland et al. ..... 239/135

(Continued)

FOREIGN PATENT DOCUMENTS

JP 56-108024 8/1981

(Continued)

*Primary Examiner*—Steven B McAllister
*Assistant Examiner*—Robert E Thomas
(74) *Attorney, Agent, or Firm*—Lahive & Cockfield, LLP; Thomas V. Smurzynski; Anthony A. Laurentano

(57) ABSTRACT

Provided is a method for operating a non-condensing boiler at maximum non-condensation efficiency, and more particularly a method for operating a non-condensing boiler, capable of supplying an appropriate amount of excess air for combustion of a burner, avoiding damaging a heat exchanger due to the condensed water generated at the heat exchanger, and effectively improving the heat efficiency. The method comprises the steps of: sensing a temperature of exchange water introduced into a heat exchanger and a temperature of supply water discharged from the heat exchanger and calculating an average temperature from the two temperatures to obtain a maximum concentration of CO using information stored in a controller; calculating a ratio of excess air (λ) from the maximum concentration of CO using a combustion equation chosen depending on a fuel used; checking from a combustion characteristic curve whether or not the excess air ratio (λ) is within a stable combustion region; when the excess air ratio (λ) is within the stable combustion region, setting this excess air ratio to the control target value, and when the excess air ratio (λ) is less than a lower limit of the stable combustion region, setting a minimum excess air ratio of the stable combustion region to the control target value; calculating a target value of air flow suitable for the current consumption amount of fuel based on the set excess air ratio; and performing feedback control with respect to the air flow target value and a value input from an air flow sensor. With this configuration, no condensation takes place during operation of the non-condensing boiler, so that the boiler can have increased durability, be easily assembled at inexpensive production costs, be made compact, and obtain maximum heat efficiency under a non-condensation condition.

3 Claims, 1 Drawing Sheet

U.S. PATENT DOCUMENTS

| | | | | |
|---|---|---|---|---|
| 4,749,122 | A * | 6/1988 | Shriver et al. | 236/14 |
| 4,791,887 | A * | 12/1988 | Winnington et al. | 122/11 |
| 6,840,198 | B2 * | 1/2005 | Kang et al. | 122/5.51 |
| 7,360,535 | B2 * | 4/2008 | Kobayashi | 126/350.1 |
| 7,414,726 | B1 * | 8/2008 | Bambeck | 356/436 |

FOREIGN PATENT DOCUMENTS

| | | |
|---|---|---|
| JP | 58-104418 | 6/1983 |
| KR | 10-1996-024108 | 7/1996 |
| KR | 10-1998-0054854 | 9/1998 |
| KR | 10-2000-0041753 | 7/2000 |

* cited by examiner

[Fig. 1]
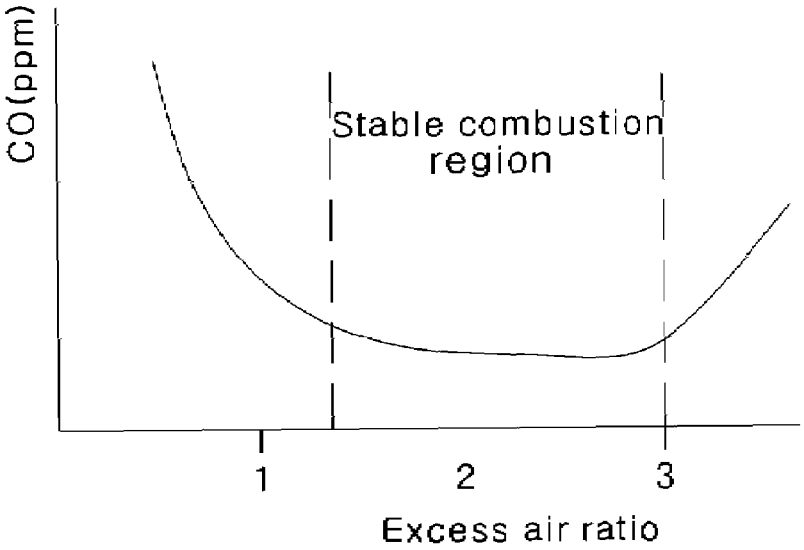
[Fig. 2]
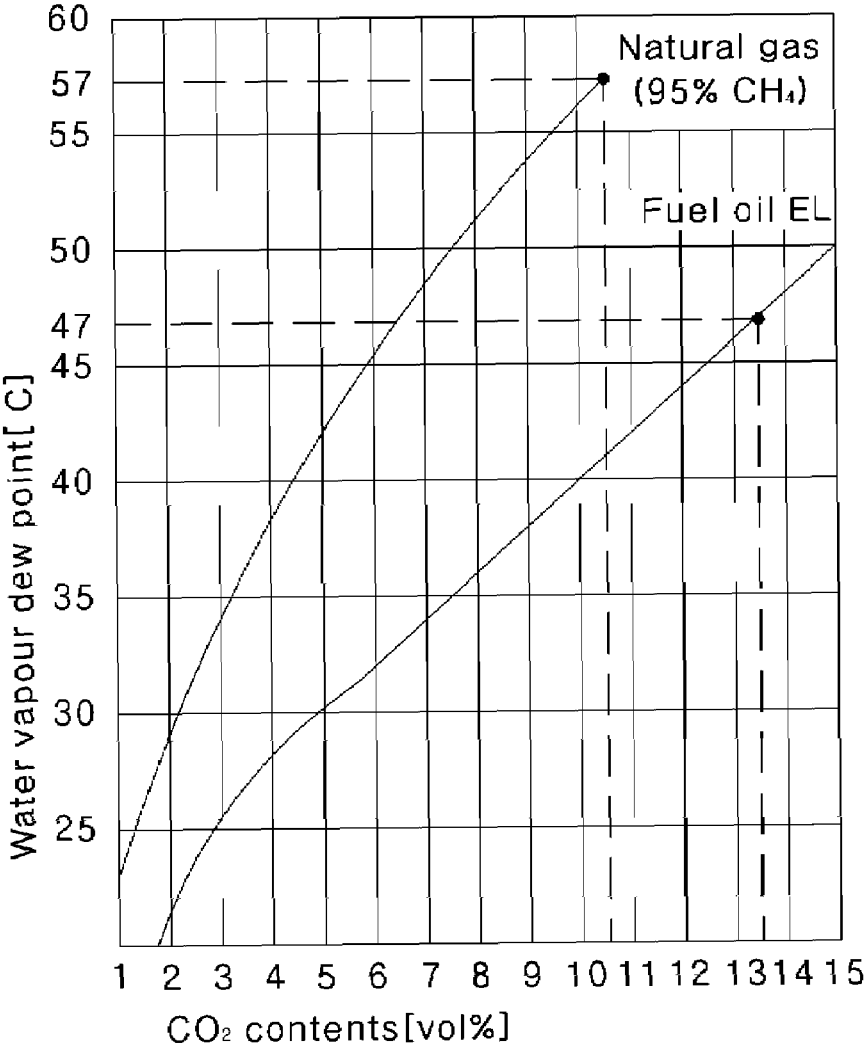

METHOD FOR MAXIMUM EFFICIENCY OF NON-CONDENSING BOILER

TECHNICAL FIELD

The present invention relates to a method for operating a non-condensing boiler at maximum non-condensation efficiency, and more particularly to a method for operating a non-condensing boiler, in which an appropriate amount of excess air is supplied for stable combustion of a burner, and water vapor formed by combustion of fuel is prevented from condensing on a heat exchanger of the boiler and damaging the heat exchanger, thereby effectively increasing heat efficiency.

BACKGROUND ART

Boilers that are mainly used in ordinary homes to heat and supply hot water are categorized into gas boilers and oil boilers according to the type of fuel used. The gas boilers sometimes use liquefied petroleum gas (LPG) as fuel, but mostly use liquefied natural gas (LNG), which is a clean fuel capable of minimizing air pollution because it contains almost none of a sulfur (S) component, compared to light oil or kerosene used for the oil boilers.

The boilers can be classified, according to the type of heat exchangers, into condensing boilers and non-condensing boilers. In the boilers that generally use gas or oil as fuel, studies for increasing heat efficiency have been multilaterally made. As a result, a condensing boiler, which makes use of the latent heat of condensation of water vapor ($H_2O$), a product of combustion, contained in an exhaust gas, has been recently developed.

A condensing heat exchanger functions to reduce the loss of radiant heat using a principle of recovering the latent heat of condensation, and is provided with a sensible heat exchanger that directly heats water using combustion heat of a burner, as well as a latent heat exchanger that heats water using the latent heat of exhaust gas passing through the sensible heat exchanger. Thus, the condensing heat exchanger can lower the temperature of exhaust gas below a dew point temperature to absorb the condensation latent heat from the exhaust gas, thereby improving heat efficiency.

In the condensing heat exchanger, however, corrosion takes place due to acidic liquid of about pH 2 to 4 which is produced by the reaction of moisture produced during condensation with sulfur oxides (in the case of the oil) or nitrogen oxides (in the case of the gas) in the exhaust gas, as well as combustion heat. Inhibition of this corrosion has always emerged as a problem. In most condensing heat exchangers for solving this problem, castings formed of special stainless steel, aluminum alloy, etc. have been used for heat exchanging fins, heat exchanging tubes, and so on, which constitute the heat exchanger. However, these condensing heat exchangers are difficult to manufacture, and are large in size and heavy in weight, so that they incur expensive production costs. Consequently, these factors act as considerable restrictions in realizing the simple assembly of the heat exchangers.

Compared to the heat exchanger of the condensing boiler, the non-condensing boiler is provided with a sensible-heat heat exchanger alone, so that it incurs relatively low production costs, is easy to assemble, and can be made compact. However, it is absolutely necessary to strictly prevent water vapor from condensing.

Unlike the condensing boiler based on the condensation of water vapor in the exhaust gas, the heat exchanger of an ordinary boiler is typically made of a material such as copper (Cu), ordinary stainless steel, or the like. When condensed water is brought into contact with the heat exchanger made of this material, serious corrosion takes place, which decreases heat exchange efficiency, and causes the function of the heat exchanger to be lost in the long run.

Thus, a method for operating the non-condensing boiler at maximum heat efficiency and without condensation is required.

DISCLOSURE OF INVENTION

Technical Problem

Accordingly, the present invention has been made keeping in mind the above problems occurring in the prior art, and an object of the present invention is to provide a method for operating a non-condensing boiler, capable of supplying an appropriate amount of excess air for combustion of a burner, avoiding damaging a heat exchanger by causing water vapor formed during the combustion of fuel to be condensed on the heat exchanger of the boiler, and effectively improving heat efficiency.

Technical Solution

A method for operating a non-condensing boiler at a maximum non-condensation efficiency, according to the present invention comprises the steps of: sensing the temperature of exchange water introduced into a heat exchanger of the non-condensing boiler and the temperature of supply water discharged from the heat exchanger by means of sensors, transmitting the sensed temperatures to a controller, and calculating an average temperature from the temperature of exchange water and the temperature of supply water at the controller; calculating a maximum concentration of $CO_2$ from the calculated average temperature on the basis of information indicating a dew point temperature depending on the concentration of $CO_2$ which is previously input into the controller; calculating a ratio of excess air ($\lambda$) from the maximum concentration of $CO_2$ on the basis of a combustion equation decided depending on the fuel used; when the excess air ratio ($\lambda$) is calculated, setting a control target value for the excess air ratio ($\lambda$) from the calculated excess air ratio; when the control target value for the excess air ratio ($\lambda$) is set, calculating a target value of air flow suitable for a current consumption amount of the fuel from the set control target value; and performing feedback control from the air flow target value and a value input from an air flow sensor, and supplying a greater amount of air than the air flow target value.

Further, the step of setting the control target value for the excess air ratio ($\lambda$) may comprise a step of determining whether or not the excess air ratio ($\lambda$) calculated from the maximum concentration of $CO_2$ is within a stable combustion region on the basis of information about the relationship between the excess air ratio ($\lambda$) that is previously input into the controller and carbon monoxide (CO).

Furthermore, after it is determined whether or not the excess air ratio ($\lambda$) calculated from the maximum concentration of $CO_2$ is within the stable combustion region, when the excess air ratio ($\lambda$) is within the stable combustion region, this excess air ratio may be set to the control target value, and when the excess air ratio ($\lambda$) is less than a lower limit of the stable combustion region, a minimum excess air ratio of the stable combustion region may be set to the control target value.

ADVANTAGEOUS EFFECTS

With this configuration, no condensation takes place during operation of the non-condensing boiler, so that the boiler can extend its durability, be easily assembled with inexpensive production costs, be made compact, and obtain maximum heat efficiency under a non-condensation condition.

BRIEF DESCRIPTION OF THE DRAWINGS

FIG. 1 shows a combustion characteristic curve (graphic relation between an excess air ratio and carbon monoxide (CO)) in accordance with an exemplary embodiment of the present invention; and FIG. 2 is a graph plotting the relationship between the concentration of $CO_2$ and a dew point temperature in accordance with an exemplary embodiment of the present invention.

BEST MODE FOR CARRYING OUT THE INVENTION

Hereinafter, exemplary embodiments of the present invention will be described in detail with reference to the attached drawings.

In the brief description of the attached drawings, FIG. 1 shows a combustion characteristic curve (graphic relationship between an excess air ratio and carbon monoxide (CO)) in accordance with an exemplary embodiment of the present invention, and FIG. 2 is a graph plotting the relationship between the concentration of $CO_2$ and a dew point temperature in accordance with an exemplary embodiment of the present invention.

FIG. 1 shows the range of an excess air ratio required for stable combustion of a burner (i.e. combustion when the amount of CO produced by unstable combustion is minimal).

Referring to FIG. 2, it is assumed that an oil fuel is used. When $CO_2$ amounts to 10.5 vol %, condensed water is formed at about 43° C. When the excess amount of air is reduced, and $CO_2$ in an exhaust gas amounts to 13.5 vol %, the condensed water is formed at about 47° C. Thus, due to an acidic liquid of about pH 2 to 4 which is produced by the reaction of moisture, generated by the condensed water, with sulfur oxides (in the case of the oil) or nitrogen oxides (in the case of the gas) in the exhaust gas, the probability of the heat exchanger corroding is increased.

The temperature, i.e. 43° C. or 47° C., at which the condensed water can be formed, is relative. When circulating water amounts to 48° C. during operation of the boiler, the condensed water is formed when $CO_2$ in the exhaust gas amounts to 13.5 vol %, but not when it amounts to 10.5 vol %. When the circulating water reaches 40° C. during operation of the boiler, the condensed water is formed when $CO_2$ in the exhaust gas amounts to 13.5 vol % or 10.5 vol %.

On the other hand, it is assumed that a gas fuel is used. When $CO_2$ amounts to 6 vol %, the condensed water is formed at about 45° C. When the excess amount of air is reduced, and $CO_2$ in the exhaust gas amounts to 10.5 vol %, the condensed water is formed at about 57° C. Thus, due to an acidic liquid of about pH 2 to 4, which is produced by the reaction of moisture caused by the condensed water with nitrogen oxides in the exhaust gas, the probability of the heat exchanger corroding is increased.

The temperature, i.e. 45° C. or 57° C., at which the condensed water can be formed is relative. When the circulating water amounts to 60° C. during operation of the boiler, the condensed water is not formed when $CO_2$ in the exhaust gas amounts to 6 vol % or 10.5 vol %. When the circulating water amounts to 50° C. during operation of the boiler, the condensed water is formed when $CO_2$ in the exhaust gas amounts to 10.5 vol %, but not when it amounts to 6 vol %. When the circulating water is at 40° C. during operation of the boiler, the condensed water is formed when $CO_2$ in the exhaust gas amounts to 6 vol % or 10.5 vol %.

MODE FOR THE INVENTION

Hereinafter, a method for operating a non-condensing boiler will be described in detail with reference to each attached drawing.

In an ordinary boiler other than a condensing boiler, the loss of heat through exhaust gas should be minimized in order to enhance heat efficiency. To achieve this objective, the amount of air supplied to a burner should be as low as possible. In other words, when more amount than necessary is supplied, residual air left after combustion is emitted outside in the form of exhaust gas, thereby increasing the heat loss. Hence, supplying a greater amount of air than is necessary does not increase the heat efficiency, but rather acts as an impediment.

Meanwhile, the exact amount of air (oxygen) needed for ideal, complete combustion of the fuel can be calculated using a complete combustion equation. This is possible under ideal combustion conditions. In practice, more air than is needed for complete combustion is supplied to perform combustion. The relationship between the ratio of this excess air ($\lambda$=practical amount of air/theoretical amount of air) and a combustion characteristic is dependent on the type of burner, but is generally shown as in FIG. 1.

Referring to FIG. 1, it can be seen that the excess air ratio, $\lambda$, belongs to a stable combustion region in which the amount of CO produced is minimized within a range of the excess air ratio of about 1.2 to 3, and thus an amount of air greater than a specific excess amount of air (greater than 1.2 of $\lambda$ in FIG. 1) should be supplied for stable combustion of the burner. Thus, when the amount of air supplied to the burner is reduced in order to increase the heat efficiency, supplying the air in less than a pre-determined amount is inadvisable.

Further, although the stable combustion of the burner is allowed by reducing the air supplied to the burner up to a minimum excess amount of air (1.2 of $\lambda$ in FIG. 1), the heat exchanger is subject to another restriction. To be specific, when the excess air is supplied below a specific amount in order to minimize the heat loss caused by the exhaust gas so as to increase the heat efficiency, the percentage (%) of $H_2O$ of the combustion products in the exhaust gas is increased, and thus the exhaust gas has a water vapor pressure higher than a saturation vapor pressure at a considerably high temperature. As a result, a condensation phenomenon is easily generated.

In this case, in order to prevent the generation of condensed water, it is required to control the condensation by increasing the amount of supplied air.

Consequently, the present invention is directed to the method for operating the non-condensing boiler, which is adapted to reduce the excess air ratio in order to improve the heat efficiency on the basis of the type of fuel and the temperature of circulating water, and perform feedback control so that the reduced excess air ratio is within the stable combustion region and also to simultaneously set an optimal excess air ratio at which no condensation occurs, thereby obtaining maximum heat efficiency under the non-condensation condition of the boiler.

Next, a description will be made of parameters influencing the increase of heat efficiency and generation of condensed water, and the relationship between each parameter while the boiler is driven according to the present invention.

First, in order to increase the heat efficiency of the boiler, the amount of supplied excess air should be decreased as set forth above. In this manner, when the amount of supplied excess air is decreased, $CO_2$ and $H_2O$ in the exhaust gas increase in concentration. In contrast, when the amount of supplied excess air is increased, $CO_2$ and $H_2O$ in the exhaust gas decrease in concentration.

FIG. 2 is a graph plotting the relationship between the concentration of $CO_2$ and a dew point temperature in accordance with an exemplary embodiment of the present invention. As shown in FIG. 2, when the amount of supplied excess air is decreased in order to increase the heat efficiency, the concentration of $CO_2$ in the exhaust gas increases, and the dew point temperature also increases at this time. This is because the absolute amount of $CO_2$ is constant, but the amount of supplied excess air is reduced, and thus the concentration of $CO_2$ compared to the total volume of exhaust gas is increased. When the temperature of circulating water supplied to the heat exchanger is lower than the dew point temperature, condensation takes place on the surface of the heat exchanger, and thus the heat exchanger will corrode. That the dew point temperature is increased means that the possibility of the temperature of circulating water being below the dew point temperature during the operation of the boiler is also increased. Thus, the durability of the heat exchanger will be deteriorated to a serious extent.

The relationship between the excess air ratio, λ, the concentration of $CO_2$, and the concentration of $H_2O$ will be described below through a combustion equation. Here, it is assumed that the type of fuel is natural gas ($CH_4$ as a main component).

(1) Complete combustion equation (when λ=1)

$$CH_4+2(O_2+aN_2)=>CO_2+2H_2O+2aN+\text{Heat} \quad (1)$$

(2) Proportional expression when the excess air ratio (λ) is changed $$CH_4+2\lambda(O_2+aN_2)=>CO_2+2H_2O+2aN_2+(2\lambda-2)O_2+\text{Heat} \quad (2)$$

In proportional expression (2), $(2\lambda-2)O_2$ refers to residual oxygen that is not subjected to reaction due to the supply of excess air. In equation (1) and expression (2), components of supplied air take into account only oxygen ($O_2$) and nitrogen ($N_2$).

In expression (2), the relative concentration of $CO_2$ against the total volume of the exhaust gas is expressed by $1/(1+2+2a\lambda(2\lambda-2))=1/(2a\lambda+2\lambda+1)$, and the relative concentration of $H_2O$ to the total volume of the exhaust gas is expressed by $2/(1+2+2a\lambda+(2\lambda-2))=2/(2a\lambda+2\lambda+1)$. Thus, the absolute amounts of $CO_2$ and $H_2O$ in the exhaust gas after the combustion reaction are maintained constant in spite of the variation in the excess air ratio (λ). In contrast, the relative concentrations of $CO_2$ and $H_2O$ in the entire exhaust gas are in inverse proportion to the excess air ratio (λ) due to the residual oxygen that is not subjected to reaction because of the excessive supply of air.

Thus, when the amount of supplied excess air is decreased in order to increase the heat efficiency, the concentrations of $CO_2$ and $H_2O$ increase compared to the total volume of the exhaust gas. In this manner, when the percentage (%) of $H_2O$ in the exhaust gas is increased, the exhaust gas has a water vapor pressure higher than a saturation vapor pressure at a given temperature. As a result, the possibility of the condensation phenomenon occurring is increased.

Hereinafter, a detailed description will be made regarding the method for operating a boiler, capable of increasing heat efficiency to a maximum extent and preventing condensation from being generated.

First, the temperature of exchange water introduced into the heat exchanger of the non-condensing boiler and the temperature of supply water discharged from the heat exchanger are sensed by sensors installed at inlet and outlet ports of the heat exchanger, and transmitted to a controller. The controller calculates the average temperature from the temperature of exchange water and the temperature of supply water.

Next, the maximum concentration of $CO_2$ is calculated from the calculated average temperature at the controller. The maximum concentration of $CO_2$ is obtained from the graph of FIG. 2. As one example, assuming that the fuel used is natural gas, and that the current average temperature of circulating water is 45° C., it can be seen that the concentration of $CO_2$ in the exhaust gas that is subjected to condensation at this temperature is 6 vol %, and thus the maximum concentration of $CO_2$ is 6 vol %.

Accordingly, the present invention is directed to adjust the excess air ratio so as to allow the boiler to be driven within a range in which no condensation takes place. Since the excess air ratio is in inverse proportion to the concentration of $CO_2$ existing in the exhaust gas as can be seen from the combustion equation above, when the current temperature of circulating water is obtained, and then the concentration of $CO_2$ at which the condensation takes place at that temperature is obtained, the excess air ratio at which the condensation takes place can be found from the combustion equation (2). Thus, it is possible to adjust the excess air ratio within the range in which no condensation takes place.

Consequently, the maximum concentration of $CO_2$ refers to the concentration of $CO_2$ in which no condensation takes place at the current temperature of circulating water. Hence, in order to operate the boiler so as not to generate condensation, the concentration of $CO_2$ should be adjusted below 6 vol % when the current temperature of circulating water is 45° C.

In this case, the information in FIG. 2 (information indicating the relationship of the dew point temperature with the concentration of $CO_2$) is previously input into the controller using a table or function. The table or function information input into the controller is derived from a calculation equation. When one concentration value of $CO_2$ is selected, the concentration of $H_2O$ depending on the type of fuel can be found from the combustion equation. The dew point temperature is obtained from the derived concentration of $H_2O$ on a saturation vapor pressure curve of $H_2O$. This calculated value is previously input into the controller based on the concentration of $CO_2$ with respect to the oil fuel and the natural gas fuel.

As mentioned above, the maximum concentration of $CO_2$ is calculated at the controller, the excess air ratio (λ) is calculated from the combustion equation (for natural gas, $CH_4+2\lambda(O_2+aN_2)=>CO_2+2H_2O+2a\lambda N_2+(2\lambda-2)O_2+\text{Heat}$) depending on the fuel used, and the calculated concentration of $CO_2$.

Thus, when natural gas is used, when the current temperature of circulating water is 45° C., when the maximum concentration of $CO_2$ is 6 vol %, and when the concentration of $CO_2$ is 6 vol %, the excess air ratio (λ) is calculated from the following equation.

$$1/(2a\lambda+2\lambda+1)=0.06(\%) \quad (3)$$

Next, when the excess air ratio (λ) is calculated in equation (3), it is preferably checked, from the combustion characteristic curve where information about the relationship between the excess air ratio (λ) and CO is indicated, whether or not the excess air ratio (λ) exists within the stable combustion region in consideration of stability of combustion.

In this case, when the excess air ratio (λ) calculated from the maximum concentration of $CO_2$ is less than the lower limit of the stable combustion region, the minimum excess air ratio (λ) (when λ=1.2 in FIG. 1) of the stable combustion region is set as a control target value. However, when the excess air ratio (λ) calculated from the maximum concentration of $CO_2$ is within the stable combustion region (when λ=1.2 to 3 in FIG. 1), this value is set as a control target value.

Here, the excess air ratio (λ) set as the control target value is a value calculated from the concentration of $CO_2$ at the dew point temperature at which condensation begin to take place. For this reason, in order to prevent the condensation from taking place during the operation of the boiler, the air should be supplied so that the excess air ratio (λ) is greater than the control target value.

As set forth above, when the control target value for the excess air ratio (λ) is calculated, the target value of air flow suitable for the current consumption amount of fuel is calculated from the combustion equation.

Then, feedback control (proportional integral derivative (PID) control, etc.) is performed while data about the air flow measured using an air flow sensor of a blower is compared with the air flow target value calculated from the excess air ratio (λ) set as the control target value.

In this case, the air should be supplied so that the amount of air supplied by the blower is greater than the calculated air flow target value in order to prevent condensation from taking place. At the same time, the air flow target value must be precisely controlled in order to simultaneously obtain maximum heat efficiency and prevent condensation from taking place, because the heat efficiency is lowered when too much air is supplied.

Although the exemplary embodiments of the present invention have been described in reference to the method for operating the non-condensing boiler, capable of supplying an excess amount of air for stable combustion of the burner, avoiding damaging the boiler due to condensed water, and effectively improving the heat efficiency, it will be appreciated by those skilled in the art that changes may be made in these embodiments without departing from the principles and spirit of the invention, the scope of which is defined in the claims and their equivalents.

INDUSTRIAL APPLICABILITY

As mentioned above, the present invention is applied to the non-condensing boiler, and is capable of supplying an appropriate amount of excess air for the combustion of the burner, avoiding damaging the heat exchanger due to the condensed water generated at the heat exchanger, and effectively improving the heat efficiency.

The invention claimed is:

1. A method for operating a non-condensing boiler at maximum non-condensation efficiency, the method comprising the steps of:

sensing a temperature of exchange water introduced into a heat exchanger of the non-condensing boiler and a temperature of supply water discharged from the heat exchanger by means of sensors, transmitting the sensed temperatures to a controller, and calculating an average temperature from the temperature of exchange water and the temperature of supply water at the controller;

calculating a maximum concentration of $CO_2$ from the calculated average temperature based on information indicating a relationship of a dew point temperature with a concentration of $CO_2$ that is previously input into the controller;

calculating a ratio of excess air (λ) from the maximum concentration of $CO_2$ using a combustion equation chosen depending on a fuel used;

when the excess air ratio (λ) is calculated, setting a control target value for the excess air ratio (λ) from the calculated excess air ratio;

when the control target value for the excess air ratio (λ) is set, calculating a target value of air flow suitable for a current consumption amount of the fuel from the set control target value; and performing feedback control with respect to the air flow target value and a value input from an air flow sensor, and supplying a greater amount of air than the air flow target value.

2. The method according to claim 1, wherein the step of setting the control target value for the excess air ratio (λ) comprises a step of determining whether or not the excess air ratio (λ) calculated from the maximum concentration of $CO_2$ is within a stable combustion region based on information about a relationship between the excess air ratio (λ) that is previously input into the controller and carbon monoxide (CO).

3. The method according to claim 2, wherein, after it is determined whether or not the excess air ratio (λ) calculated from the maximum concentration of $CO_2$ is within the stable combustion region, when the excess air ratio (λ) is within the stable combustion region, this excess air ratio is set to the control target value, and when the excess air ratio (λ) is less than a lower limit of the stable combustion region, a minimum excess air ratio of the stable combustion region is set to the control target value.

* * * * *